US005951240A

United States Patent [19]

Mirsky et al.

[11] Patent Number: 5,951,240

[45] Date of Patent: Sep. 14, 1999

[54] METHOD AND APPARATUS FOR IMPROVING ANTISURGE CONTROL OF TURBOCOMPRESSORS BY REDUCING CONTROL VALVE RESPONSE TIME

[75] Inventors: Saul Mirsky; Paul F. Fisher, both of West Des Moines, Iowa

[73] Assignee: Compressor Controls Corporation, Des Moines, Iowa

[21] Appl. No.: 08/976,308

[22] Filed: Nov. 21, 1997

[51] Int. Cl.[6] ..... F01B 25/00

[52] U.S. Cl. ..... 415/1; 415/13; 415/17; 415/26; 415/27; 415/28; 415/47; 415/49; 417/440

[58] Field of Search ..... 415/1, 13, 17, 415/26, 27, 28, 47, 49; 417/440; 137/102; 251/29; 91/442

[56] References Cited

U.S. PATENT DOCUMENTS

| | | | |
|---|---|---|---|
| 3,462,115 | 8/1969 | Barker | 251/29 |
| 3,778,695 | 12/1973 | Bauer, Jr. | 318/481 |
| 3,863,110 | 1/1975 | Bauer, Jr. | 317/31 A |
| 4,046,490 | 9/1977 | Rutshtein et al. | 417/28 |
| 4,142,838 | 3/1979 | Staroselsky . | |
| 4,256,130 | 3/1981 | Smith et al. | 137/1 |
| 4,486,142 | 12/1984 | Staroselsky . | |
| 4,936,740 | 6/1990 | Blotenberg | 415/27 |
| 5,242,263 | 9/1993 | Mondolini | 415/27 |
| 5,762,468 | 6/1998 | Blotenberg | 415/26 |

OTHER PUBLICATIONS

Copy—8 pages, dated Nov. 19, 1991 document entitled High Pressure Valve Positioning Specification—Revision 0.
Copy—2 pages, dated Aug. 1973—document.
Copy—6 pages—entitled A Method for Correcting Turbine–Generator Sudden Load Loss by Audrey J. Smith and George Platt.
Copy—14 pages document entitled Improved Reliability of Bulk Power Supply by Fast Load Control by R.H. Park.
Copy—10 page document entitled Fast Valving as an Aid to Power System Transient Stabiligy and Prompt Presynchronization and Rapid Reload After Full Load Rejection.
Copy—8 pages of a Conference Paper entitled Some Model Experiments in Fast Valving to Improve Transient Stability by A.C. Sullivan and F.J. Evans.
Copy—8 page document (dated 1980) and entitled Turbine Overspeed Control Behaviour by G.P. Schatzmann—BBC Brown Bovert Company.

(List continued on next page.)

*Primary Examiner*—Edward K. Look
*Assistant Examiner*—Matthew T. Shanley
*Attorney, Agent, or Firm*—Henderson & Sturm

[57] ABSTRACT

The stroking speed of an antisurge control valve is impeded by the combined damping effects of signal dead time and the inherent lag of ancillary pneumatic components within a primary control loop. Furthermore, as control valve actuator size increases, the negative influence of these two impediments (dead time and lag) is amplified. As a result, control valve response times are adversely affected; and the possibilities of surge-induced compressor damage and process upsets are heightened. For these reasons, this disclosure relates to a method for protecting turbocompressors from impending surge, and for preventing subsequent process upsets, by improving antisurge control. But more specifically, it describes a technique for decreasing damping effects by evacuating control valve actuators (diaphragm or piston) through restrictions having a lower resistance to compressible-fluid flow rather than through volume boosters—consequently, increasing a control valve's opening speed to that of an emergency shutdown. The proposed method (1) allows continuous control of antisurge control valves and (2) incorporates both solenoid valves and quick exhaust valves (located adjacent to the actuators) which are manipulated by predefined discrete signals from antisurge controllers.

12 Claims, 3 Drawing Sheets

OTHER PUBLICATIONS

Copy—9 page document entitled Fast Turbine Valving by Robert H. Park, Fellow IEEE, Member ASME—Brewster, Massachusetts.

Copy, 8 pages dated 1980—entitled Steam Turbine Overspeed Control and Behavior During System Disturbances—T.D. Younkins, Member IEEE and L.H. Johnson.

Copy—60 pages—booklet dated Mar., 1991 entitled Controlling and Protecting Centrifugal and Axial Compressors Using Series 3 Controllers by Compressor Controls Corporation.

Copy—211 page booklet dated Feb. 17, 1997 entitled Series 3 Plus Antisurge Controller—by Compressor Controls Corporation.

METHOD AND APPARATUS FOR IMPROVING ANTISURGE CONTROL OF TURBOCOMPRESSORS BY REDUCING CONTROL VALVE RESPONSE TIME

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

AUTHORIZATION PURSUANT TO 37 C.F.R. §1.71(d)(e)

A portion of the disclosure of this patent document, including appendices, may contain material which is subject to copyright protection. The copyright owner has no objection to the facsimile reproduction by anyone of the patent document or the patent disclosure, as it appears in the patent and Trademark Office patent file or records, but otherwise reserves all copyright rights whatsoever.

1. Technical Field

This invention relates generally to a method and apparatus for protecting turbocompressors from impending surge, and for preventing subsequent process upsets, by improving antisurge control. More specifically, the invention relates to a method that reduces antisurge control valve response time by decreasing the combined damping effects of signal dead time and the lag of pneumatic components within primary control loops, thereby increasing valve stroking speed beyond what is achievable with existing techniques.

2. Background Art

Under current normal conditions, the stroking speeds of antisurge control valves are limited by the rate at which gas (air) actuators, either diaphragm or piston, can be evacuated through volume boosters. Associated with this valve-opening action are a pure dead time and a lag time. The dead time—interval between a change in an input signal and the response to that signal—is attributed (at least) to static friction and linkage play, and is the result of moving a compressible fluid through a restriction; whereas lag time is inherent to pneumatic elements, such as volume boosters, positioners, I/P transducers, and actuator volume. The combined damping influence of these two impediments (dead time and lag), within a primary control loop, amplifies as control valve actuator size increases. However, both of these limiting effects can be reduced substantially by evacuating the actuators through restrictions having a lower resistance to compressible-fluid flow rather than through volume boosters; thus accelerating the stroking speed. It should be noted that present-day, accelerated evacuation methods (emergency shutdowns) utilize combinations of solenoid valves and quick exhaust valves.

DISCLOSURE OF THE INVENTION

The purpose of this invention is to improve upon the prior art by introducing a method for increasing the stroking speeds of antisurge control valves beyond what is achievable with existing techniques; consequently, lessening the possibilities of surge-induced compressor damage and process upsets. For signal-to-close, fails-open valves functioning with ancillary pneumatic components (for example, volume boosters, positioners, and I/P transducers), stroking speeds are negatively influenced by the cumulative damping impact of signal dead time and the intrinsic lag of pneumatic components. Both the dead time and the lag time can, potentially, be reduced by evacuating gas (air) actuators, either diaphragm or piston, through restrictions having a lower resistance to compressible-fluid flow rather than through volume boosters. This invention suggests such an approach by utilizing an alternative route for the evacuation of the pressurized air (in the control valve actuator) that allows a much faster response of the control valves when step changes are required. The proposed method incorporates combinations of solenoid valves and quick exhaust valves, located adjacent to the actuators. With these valve groups in place, antisurge controllers will generate analog signals to modulate control valves and, at the same time, generate discrete signals (for a predetermined but variable time) to regulate the solenoid valves. These discrete signals initiate immediate collective actions involving solenoid and quick exhaust valves, which cause the recycle or blowoff valves to open more quickly than by passing actuator air solely through the volume boosters—resulting in a significant reduction of valve response time. Following this opening action (1) the control valve's position signal reaches a predetermined value, (2) the antisurge controller generates a HIGH output signal to energize the solenoid valve and terminate actuator venting, and (3) the control valve returns to a position dictated by the positioner and volume booster. Moreover, the predetermined value of the control valve's position signal is variable during operation.

BEST MODE FOR CARRYING OUT THE INVENTION

Figure 1:
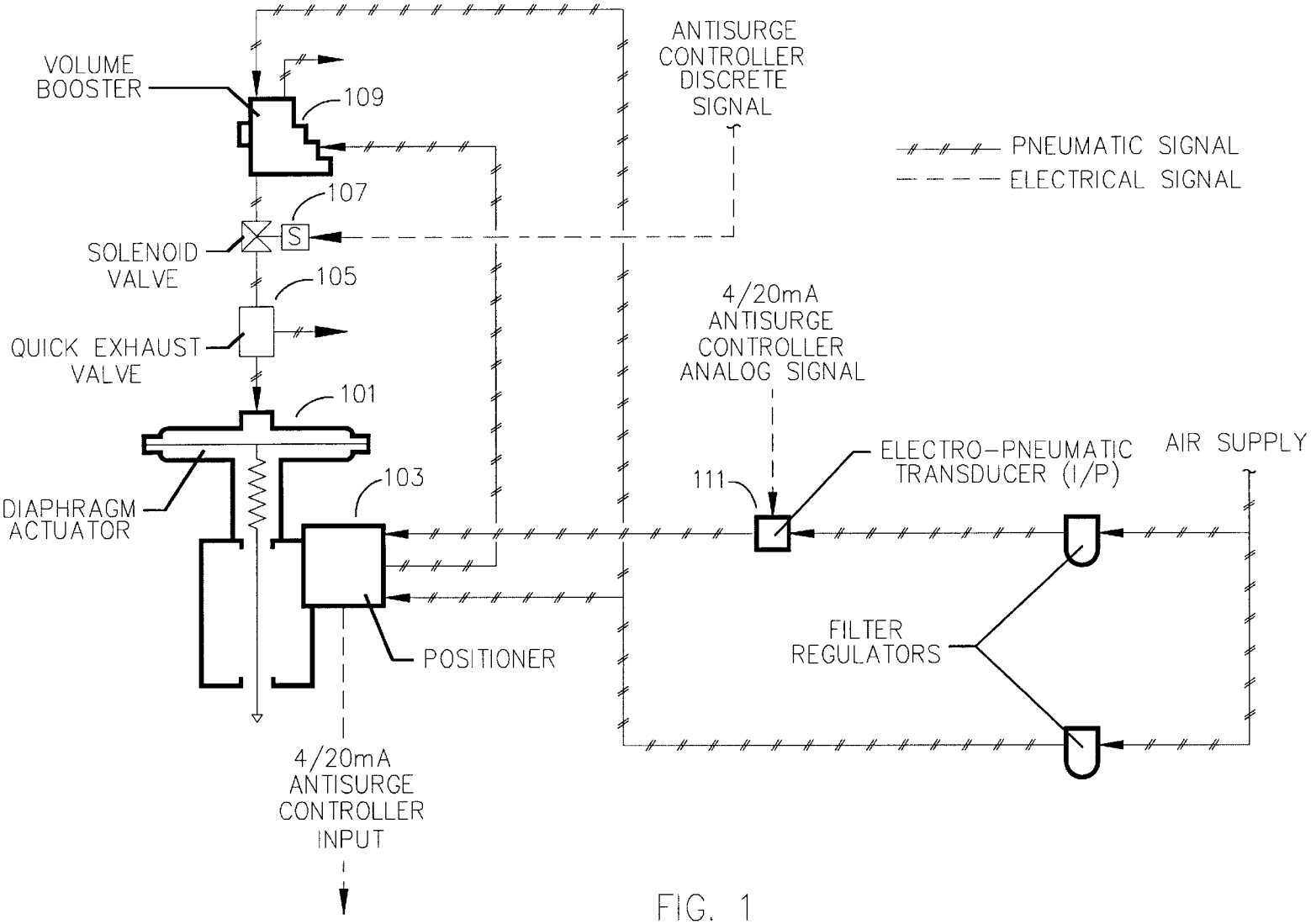
FIG. 1 shows a control schematic with associated piping, a diaphragm actuator, and ancillary components.
Figure 2:
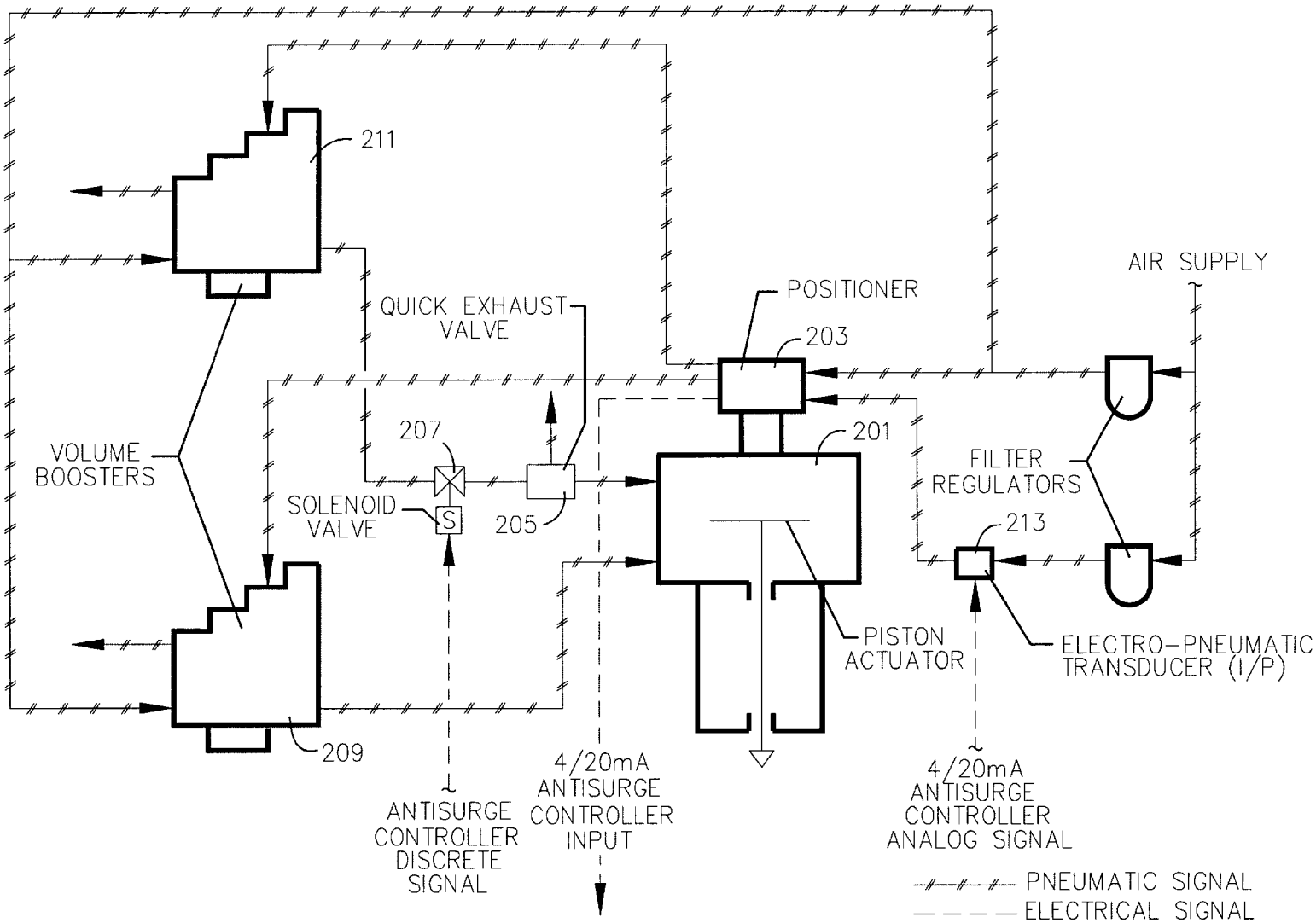
FIG. 2 shows a control schematic with associated piping, a piston actuator, and ancillary components.
Figure 3:
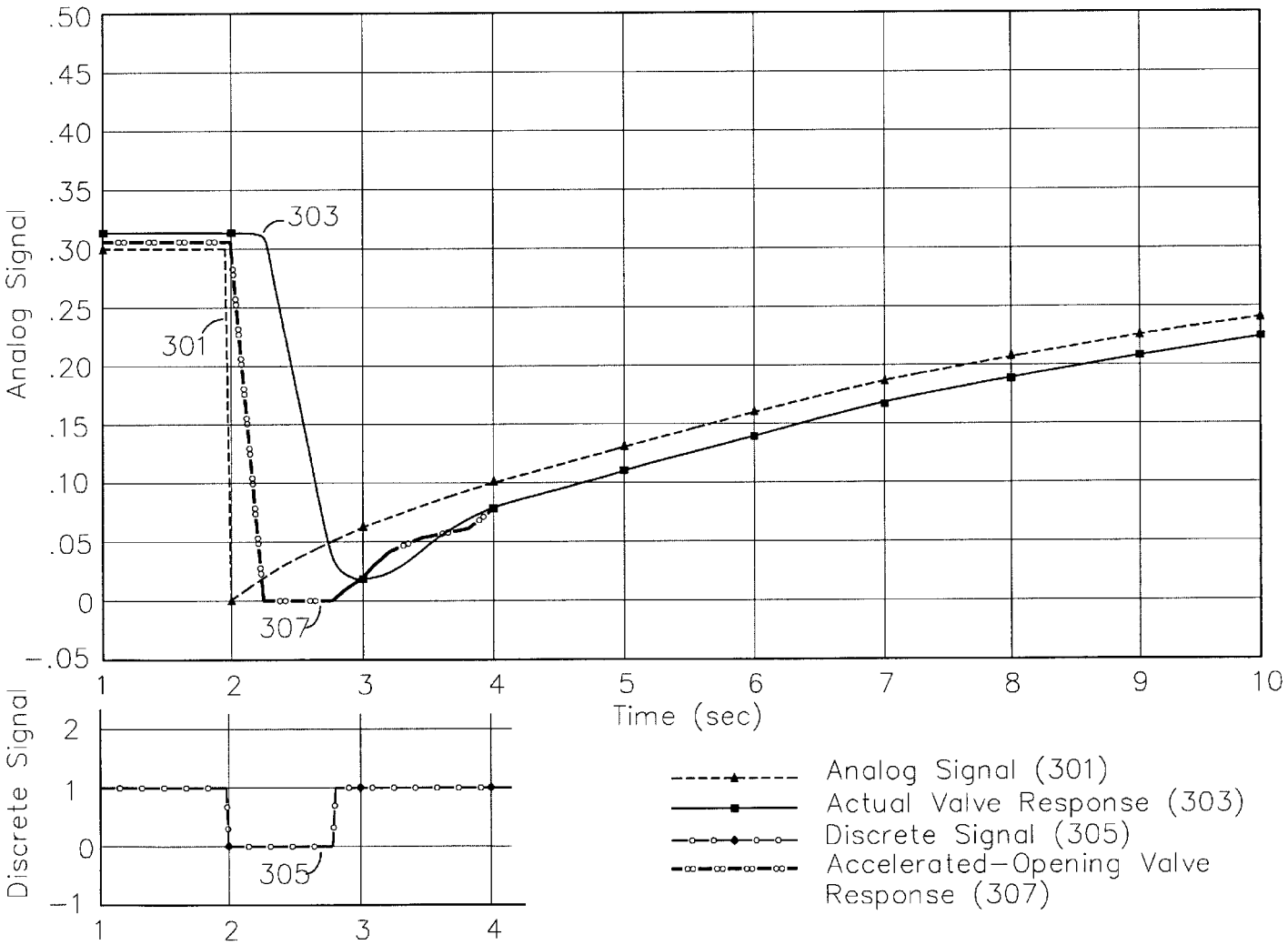
FIG. 3 shows a comparison of controller signals and control valve responses.

Protecting turbocompressors from surge-induced damage, as well as preventing subsequent process upsets, can be augmented by reducing control valve response time; that is, by lessening the detrimental damping effects of signal dead time and the inherent lag of supplemental pneumatic components—both impediments being common to pneumatic-actuated valves. Currently, the stroking speeds of antisurge control valves (recycle or blowoff) are limited by the rate at which control valve actuators (diaphragm or piston) can be evacuated through volume boosters. But, by installing combinations of solenoid valves and quick exhaust valves adjacent to the actuators, stroking speeds can be increased beyond what is achievable with existing methods; as a result, the threat of impending surge is significantly diminished. It should be noted that many control valve actuators presently utilize a similar setup (pairs of solenoid valves and quick exhaust valves) for emergency shutdown situations, which differs in scope from the continuous control method disclosed in this invention. FIG. 1 depicts a control schematic with associated piping, comprising a signal-to-close, fails-open valve's diaphragm actuator 101 and five ancillary pneumatic components: a positioner 103, a quick exhaust valve 105, a three-way solenoid valve 107, a volume booster 109, and an I/P transducer 111. The process procedure used for a layout such as FIG. 1 initially involves continuously monitoring and maintaining (by the positioner 103) the position of the antisurge control valve. When, at some moment, the antisurge controller determines that an instantaneous opening (of a given amplitude) of the control valve is required, the controller generates (for a predetermined time) a discrete signal to be acted upon by the solenoid valve 107. Because a solenoid valve's action is on-off, it must be exhausted to the atmosphere for just the duration required to attain the desired opening of a control valve, which means that (1) this duration is calculated at the time of commissioning or (2) the position of the control valve is monitored during operation. Upon receiving a discrete signal (input LOW), the solenoid valve 107 is de-energized (for a predetermined duration) enabling it to exhaust. Next, the quick exhaust valve 105 senses a drop in its inlet pressure (because of solenoid exhausting) and quickly vents actuator air; thus, allowing the control valve to open at a speed corresponding to that of an emergency shutdown. During this venting interval the control valve's position continues to be monitored, and upon reaching a predefined value or upon the expiration of a calculated time interval (a) the antisurge controller generates a HIGH output signal, (b) the solenoid valve 107 is energized causing a cessation of actuator venting, and (c) the control valve begins returning to a closed-loop position dictated by the positioner 103 and the volume booster 109. Furthermore, although FIG. 1 and its process procedure collectively describe a technique using diaphragm actuators, the same pneumatic components and control method apply to piston actuators with push-up spring return. FIG. 2 depicts a control schematic with associated piping, comprising a signal-to-close, fails-open valves's piston actuator 201 and six ancillary pneumatic components: a positioner 203, a quick exhaust valve 205, a three-way solenoid valve 207, two volume boosters 209, 211, and an I/P transducer 213. The process procedure used for a layout such as FIG. 2 involves the same control method for continual monitoring and maintaining of an antisurge control valve's position (by the positioner 203) as that for FIG. 1. This type of piston actuator (push-pull) reacts to a pressure imbalance created by loading supply pressure on one side of the piston and unloading the opposite side rather than employing a spring action. A predetermined discrete signal (output LOW), from an antisurge controller, sets in motion a rapid venting of the actuator 201 followed by a quick opening of the control valve, initiated by the solenoid and quick exhaust valves. During this venting interval the control valve's position continues to be monitored; and when it reaches a defined value, the controller transmits a HIGH output signal to the solenoid valve 207 terminating actuator venting. Returning the control valve to a closed-loop position (as dictated by the positioner 203 and the volume boosters 209, 211) involves position feedback from the antisurge controller, thereby preventing overcorrection and ensuring a definite position of both the piston and the control valve. FIG. 3 shows two comparison graphs (analog and discrete) of antisurge controller signals and control valve responses applicable to both types of actuators depicted in FIGS. 1 and (2), beginning with an analog signal 301 generated as an instantaneous step-change of certain amplitude—in the valve-open direction. This output signal 301 represents a desired valve position (free from damping effects) and is routed through an I/P transducer 111, (213) and through a positioner 103, (203) resulting in an accelerated opening of a control valve by a volume booster 109, (211); the valve then returns to normal closed-loop operation by a slow, closing motion. Because of damping effects and their negative influence, the control valve's reaction to the analog signal 301 is now displayed as an actual valve response 303. However, if a controller sends a discrete signal 305 (output LOW) to a solenoid valve 107, (207) at the same time it sends the analog signal to an I/P transducer 111, (213), the damping influences are, to a large extent, circumvented. The discrete signal graph of FIG. 3 displays the characteristics (timing plot) of a controller's discrete HIGH—LOW—HIGH signal 305 as transmitted to a three-way solenoid valve 107, (207). Duration of the LOW pulse is predetermined and also variable during operation The result is an accelerated-opening valve response 307 approximately three times that of the actual valve response 303—comparable to the opening speed in an emergency shutdown.

Obviously, many modifications and variations of the present invention are possible in light of the above teachings. It is, therefore, to be understood that within the scope of the appended claims, the invention may be practiced otherwise than as specifically described.

We claim:

1. A method for protecting a turbocompressor from impending surge, the turbocompressor having associated piping and an antisurge control valve modulated by an actuator, the actuator outfitted with a quick exhaust valve and a solenoid valve the method comprising:

generating a discrete signal for a predetermined time; and sending the discrete signal to the solenoid valve, thereby enabling the quick exhaust valve to increase the stroking speed of the antisurge control valve.

2. The method of claim 1 wherein the antisurge control valve is modulated by either a diaphragm actuator or a piston actuator.

3. The method of claim 1 wherein the discrete signal is generated by an antisurge controller.

4. The method of claim 1 wherein the predetermined time is variable.

5. A method for protecting a turbocompressor from impending surge, the turbocompressor having associated piping and an antisurge control valve modulated by an actuator, the actuator outfitted with a quick exhaust valve, a solenoid valve and a positioner generating a signal indicating a position of the antisurge control valve, the method comprising:

(a) generating a discrete signal and sending the discrete signal to the solenoid valve, thereby enabling the quick exhaust valve to increase the stroking speed of the antisurge control valve;

(b) monitoring the antisurge control valve's position signal from the positioner; and (c) ceasing to generate the discrete signal when the antisurge control valve's position signal reaches a predetermined value.

6. The method of claim 5 wherein the predetermined value of the antisurge control valve's position signal is variable during operation.

7. An apparatus for protecting a turbocompressor from impending surge, the apparatus comprising:

an actuator outfitted with a quick exhaust valve;

an antisurge control valve modulated by the actuator;

a solenoid valve; and means for generating a discrete signal for a predetermined time and sending the discrete signal to the solenoid valve, thereby enabling the quick exhaust valve to increase the stroking speed of the antisurge control valve.

8. The apparatus of claim 7 wherein the antisurge control valve is modulated by either a diaphragm actuator or a piston actuator.

9. The apparatus of claim 7 wherein the discrete signal is generated by an antisurge controller.

10. The apparatus of claim 7 wherein the predetermined time is variable.

11. An apparatus for protecting a turbocompressor from impending surge, the turbocompressor having associated piping and an antisurge control valve modulated by an actuator, the actuator outfitted with a quick exhaust valve, a solenoid valve and a positioner generating a signal indicating a position of the antisurge control valve, the apparatus comprising:

(a) means for generating a discrete signal and sending the discrete signal to the solenoid valve, thereby enabling the quick exhaust valve to increase the stroking speed of the antisurge control valve;

(b) means for monitoring the antisurge control valve's position signal from the positioner; and (c) means for ceasing to generate the discrete signal when the antisurge control valve's position signal reaches a predetermined value.

12. The apparatus of claim 11 wherein the predetermined value of the antisurge control valve's position signal is variable during operation.

* * * * *